US006994024B2

(12) United States Patent
Corcoran et al.

(10) Patent No.: US 6,994,024 B2
(45) Date of Patent: Feb. 7, 2006

(54) EMBOSSING SYSTEM TO BE USED WITH A DIE PRESS

(75) Inventors: Kevin L. Corcoran, Mission Viejo, CA (US); David L. Hughes, Rancho Santa Margarita, CA (US)

(73) Assignee: Ellison Educational Equipment, Inc., Lake Forest, CA (US)

( * ) Notice: Subject to any disclaimer, the term of this patent is extended or adjusted under 35 U.S.C. 154(b) by 0 days.

(21) Appl. No.: 10/667,904

(22) Filed: Sep. 16, 2003

(65) Prior Publication Data

US 2004/0118304 A1 Jun. 24, 2004

Related U.S. Application Data

(60) Provisional application No. 60/411,358, filed on Sep. 16, 2002, provisional application No. 60/488,520, filed on Jul. 17, 2003.

(51) Int. Cl.
*B31F 1/07* (2006.01)

(52) U.S. Cl. ..... 101/4; 101/28

(58) Field of Classification Search ..... 101/3.1, 101/4, 22, 23, 18–21, 28–32, 126, 127.1

See application file for complete search history.

(56) References Cited

U.S. PATENT DOCUMENTS

| | | | | |
|---|---|---|---|---|
| 2,029,567 | A * | 2/1936 | Hough | 76/107.1 |
| 4,542,691 | A * | 9/1985 | Kokrhanek | 101/114 |
| 4,979,613 | A * | 12/1990 | McLaughlin et al. | 206/233 |
| 5,181,464 | A * | 1/1993 | Kuhlman et al. | 101/28 |
| 5,188,026 | A * | 2/1993 | Fuqua et al. | 101/129 |
| 5,590,910 | A * | 1/1997 | Meth | 281/45 |
| 5,722,319 | A * | 3/1998 | Hirano | 101/23 |

* cited by examiner

*Primary Examiner*—Ren Yan
(74) *Attorney, Agent, or Firm*—Townsend and Townsend and Crew

(57) ABSTRACT

Disclosed is an embossing system to be used with a die press. The embossing system includes a force transfer assembly, which comprises a first cover and an opposite second cover with the first and second covers being connected by a hinge. The force transfer assembly further includes a stencil and an opposing form positioned internal of the force transfer assembly. The stencil and the form are adapted to sandwich an embossing material, such as paper, between the stencil and the form. The embossing system further includes a layer of static vinyl that is located internally of one of the covers to secure the form to the internal side of one of the covers. The embossing system also utilizes an adhesive located on the cover opposite the cover with the vinyl to secure the stencil to the internal side of the opposite cover.

23 Claims, 8 Drawing Sheets

112
116
114
2A
112
214
212
216
210
114
2B
110
116

EMBOSSING SYSTEM TO BE USED WITH A DIE PRESS

CROSS-REFERENCES TO RELATED APPLICATIONS

This application claims priority to U.S. Provisional Application No. 60/411,358 filed Sep. 16, 2002 and U.S. Provisional Application No. 60/488,520 filed Jul. 17, 2003 which are herein incorporated by reference for all purposes.

BACKGROUND OF THE INVENTION

Disclosed is an embossing system to be used with a die press and, more particularly, an embossing system with a die press that uses a force transfer assembly to apply pressure to an embossing material, such as paper.

Stencils are typically used for embossing a pattern upon an embossing material, such as paper. Currently, a stencil with a pattern is placed on a light table and a probe is used to apply pressure to the embossing material against the stencil, so that the pattern in the stencil is embossed manually upon the embossing material. This is a tedious and time consuming task and produces inconsistent results since uniform pressure is not applied to each portion of the stencil or to the embossing material.

Therefore, there is a need for an embossing system to be used with a die press or other press that provides generally uniform pressure across the length of the stencil.

BRIEF SUMMARY OF THE INVENTION

Disclosed is an embossing system to be used with a die press. The embossing system includes a force transfer assembly, which comprises a first cover and an opposite second cover with the first and second covers being connected by a hinge or the like. The force transfer assembly further includes a stencil and an opposing form positioned internal of the force transfer assembly. The stencil and the form are adapted to sandwich an embossing material, such as paper, between the stencil and the form. The embossing system further includes a layer of static vinyl that is located internally of one of the covers to secure the form to the internal side of one of the covers. The embossing system also utilizes an adhesive or some other means located on the cover opposite the cover with the vinyl to secure the stencil to the internal side of the opposite cover.

BRIEF DESCRIPTION OF THE DRAWINGS

The disclosure will now be described in greater detail with reference to the preferred embodiments illustrated in the accompanying drawings, in which like elements bear like reference numerals, and wherein.

DETAILED DESCRIPTION OF THE INVENTION

Disclosed is an embossing system that utilizes a force transfer assembly, or a shuttle, to be used with a die press, so that compressive forces may be transferred through the force transfer assembly so as to apply pressure to an embossing material, such as paper, or some other material, that is positioned between a form and a stencil, and wherein the form acts as male component and the stencil acts as a female component. After compressive forces have been applied to the embossing material, the embossing material is embossed with the pattern from being sandwiched between the form and the stencil. The embossing system of the present disclosure, which may be utilized in a die press, provides a quick and efficient means to emboss an embossing material or other item with consistent results since uniform pressure is applied to the force transfer assembly and to the embossing material.

Figure 1:
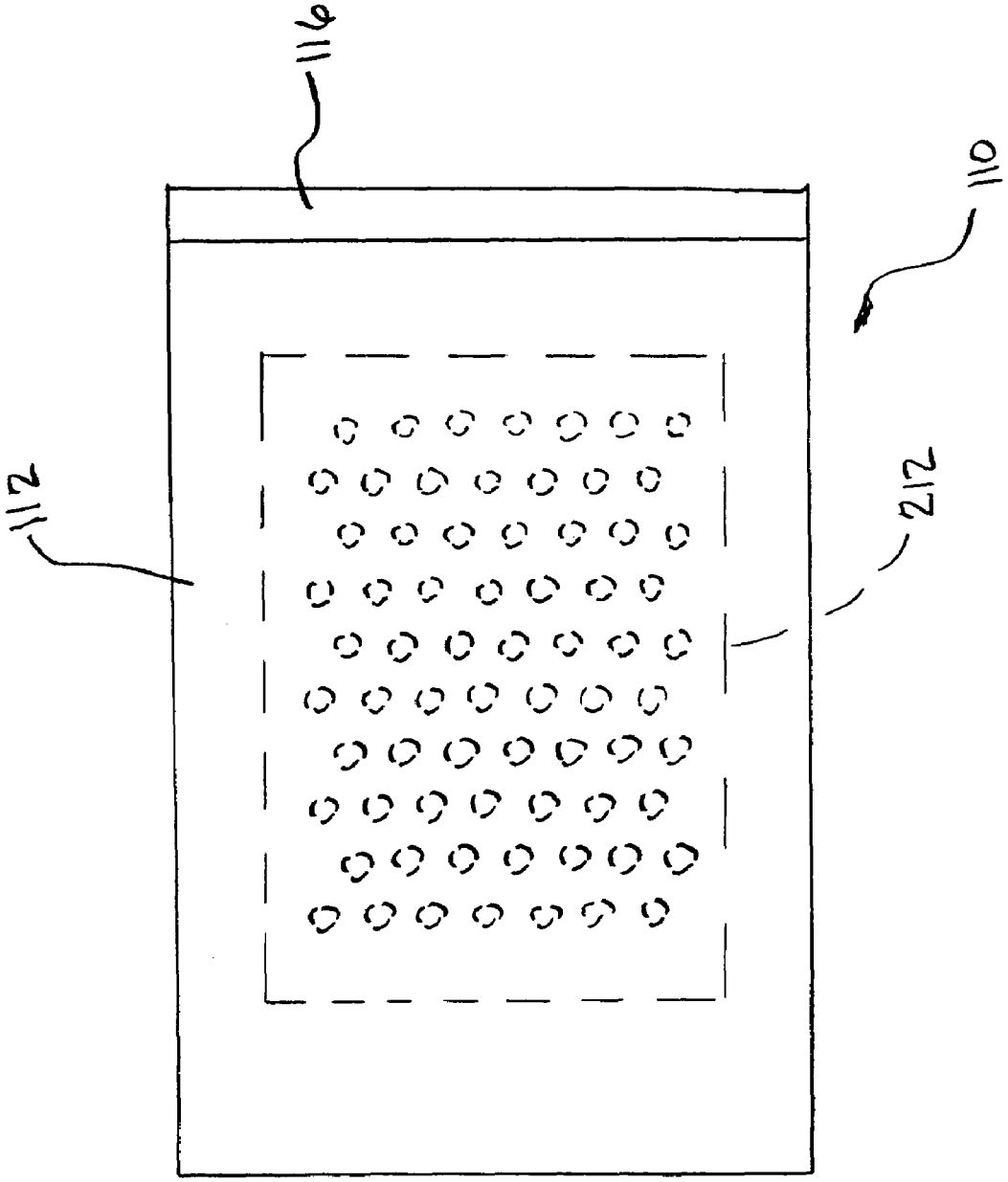
FIG. 1 illustrates a top view of a force transfer assembly according to the present disclosure.
Figures 2, 2A, 2B:
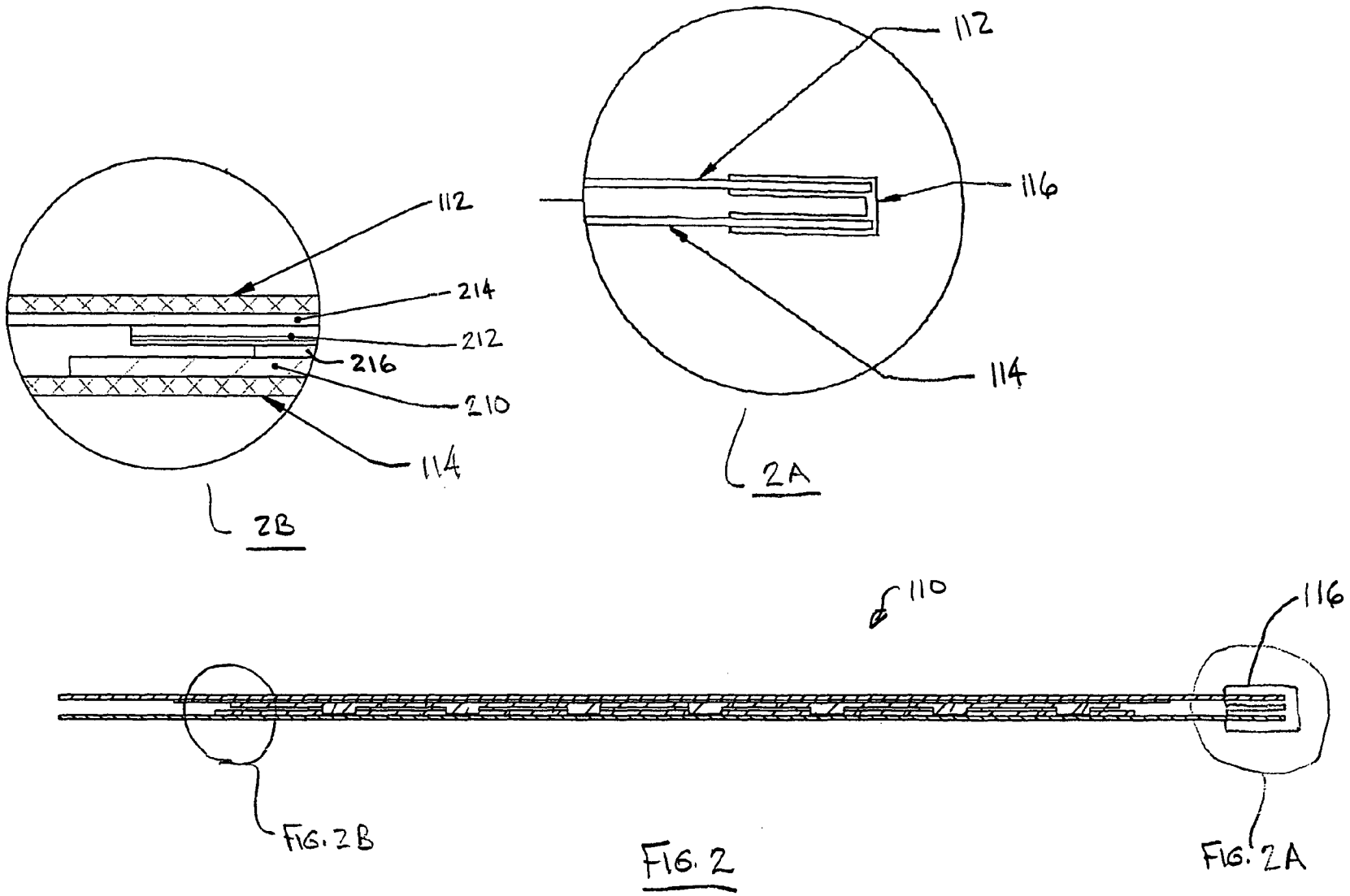
FIG. 2 illustrates a side view and close up side views of the force transfer assembly according to the present disclosure.

Shown in FIG. 1 is a top view of the force transfer assembly, or shuttle, according to the present disclosure. The shuttle is made of a lightweight material that is conveniently removable from a die press so that the formed plastic and the stencil, as well as the embossing material may be placed inside of the shuttle. The shuttle then is easily placed between the platens of a die or rollers of a roller press so that compressive forces may be applied to the shuttle and ultimately to the embossing material that is sandwiched between the form and the stencil. As shown in FIG. 2, including views 2A and 2B, the shuttle 110 includes a top plastic sleeve 112, and an opposite bottom plastic sleeve 114. The sleeves are pivotally connected by a flexible hinge 116. In one embodiment, the plastic sleeves 112 and 114 are made of clear polycarbonate sheet material that are ductal enough so as to allow the transfer of compressive forces from the die press to the embossing material, however, the plastic sleeves 112 and 114 need to be durable enough to withstand multiple embossing sessions. By way of example, the applicant has successfully manufactured prototype shuttles utilizing polycarbonate plastic sleeves that are approximately 0.0175 inches in thickness, and that are approximately 4 inches wide by 5 inches long. Likewise, the flexible hinge is durable enough to continuously position the top plastic sleeve 112 in the same position in relation to the bottom plastic sleeve 114 each time that the shuttle is opened to insert or remove the components internal of the sleeve or to remove or place the embossing material from or into the shuttle. In one embodiment, the flexible hinge 116 may be made of a flexible vinyl material that is flexible yet durable enough to provide continued and accurate placement of the top sleeve 112 in relation to the bottom sleeve 114 during operation, such as a low density plastic or adhesive.

As shown in FIG. 2, positioned between the top sleeve 112 and the bottom sleeve 114 is a stencil 210 and a form 212, with the embossing material 216 positioned between the stencil 210 and the form 212. In one embodiment, an adhesive is located between the form 212 and the top sleeve 112 so as to hold the form in place during placement of the embossing material 216 into the shuttle and during operation of the embossing system. In one embodiment, the adhesive is a static vinyl sheet 214 that adheres to the top sleeve 112 and that statically adheres the form 212 to the top sleeve 112. In addition, an adhesive, such as a sticky adhesive, is utilized to adhere the stencil 210 to the bottom plastic sleeve 114. It should be appreciated that although shown in FIG. 2 that the stencil 210 is located adjacent to the bottom sleeve 114 and the form 212 is located adjacent to the top sleeve 112, that the arrangement of the components shown are for illustration purposes only and that the arrangement of the components located between the sleeves 112 and 114 could be reversed and provide the same function as disclosed herein.

In one embodiment, the static vinyl 214 is made from a static cling vinyl sheet provided by Grafix, of Cleveland, Ohio, 44128. Further, in one embodiment, the stencil 210 is a brass stencil that has either been chemically etched, machined, or stamped with a pattern formed in the stencil. In the example shown in the figures, the stencil has a plurality of through holes arranged in an alternating offset pattern. The stencil, however, could have any pattern or shape of openings or reliefs. A relief is a depression or recessed portion in the stencil, but not a through hole or shape. The stencil acts as a female component that mates with the form 212.

Figure 3:
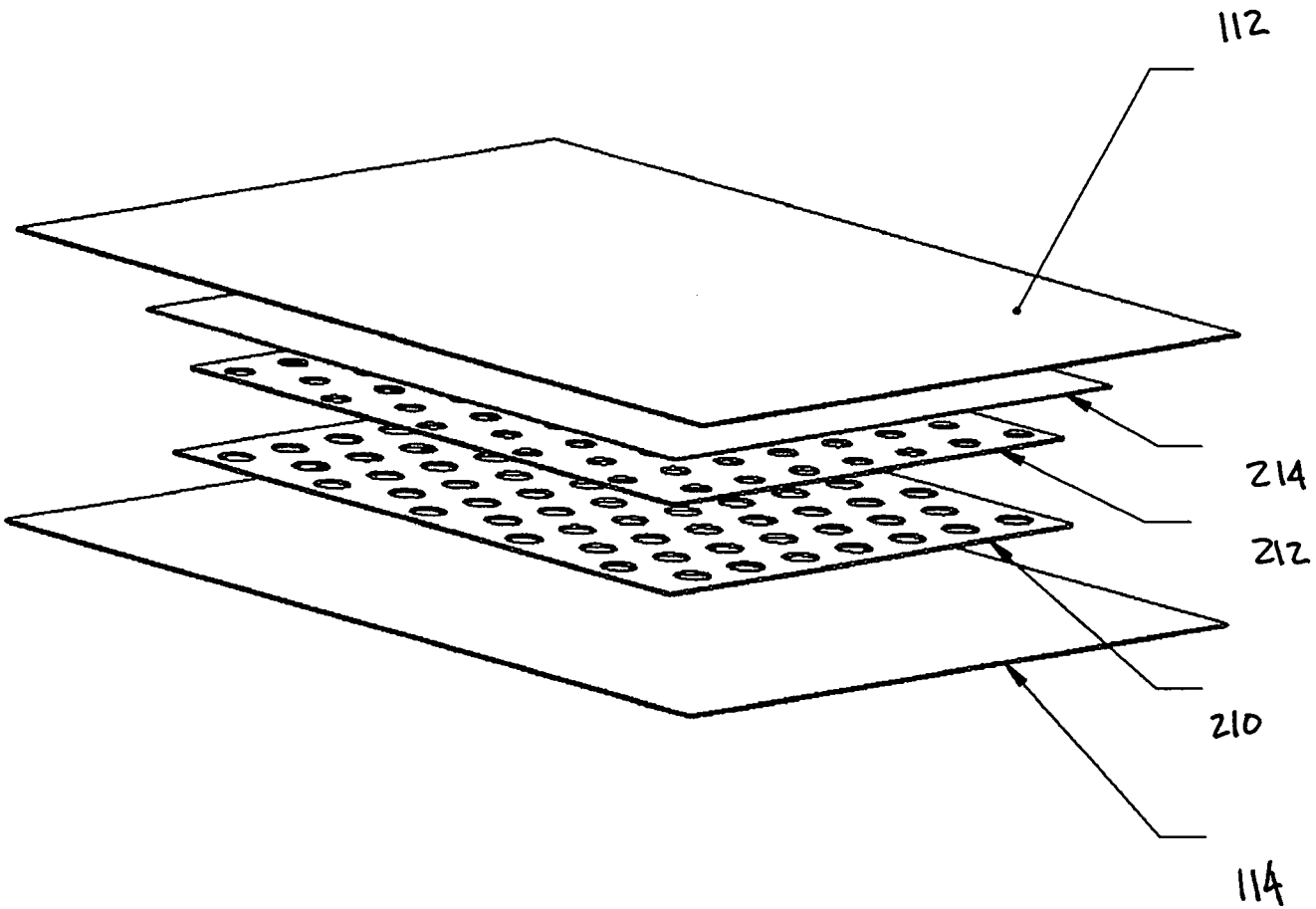
FIG. 3 is a perspective exploded view of the force transfer assembly according to the present disclosure.

FIG. 3 illustrates an exploded view of the shuttle according to the present disclosure without the hinge being shown, and without the embossing material being shown located between the form 212 and the stencil 210. As described above, an adhesive may be used to position and to secure the stencil 210 to the sleeve 114. Further, FIG. 3 further illustrates how the male form 212 mates with the stencil 210, so as to emboss a certain configuration onto the embossing material when compressive forces are applied to the shuttle. FIG. 3 also further illustrates how the shuttle of the present disclosure allows for uniform pressure to be applied upon the embossing material when the shuttle is placed between two platens of a die press or between two rollers of a roller press. A typical example of a die press that may be used with the present disclosure is disclosed in U.S. Pat. No. 5,255,587, which is commonly assigned to the Assignee of the present disclosure.

Figure 4:
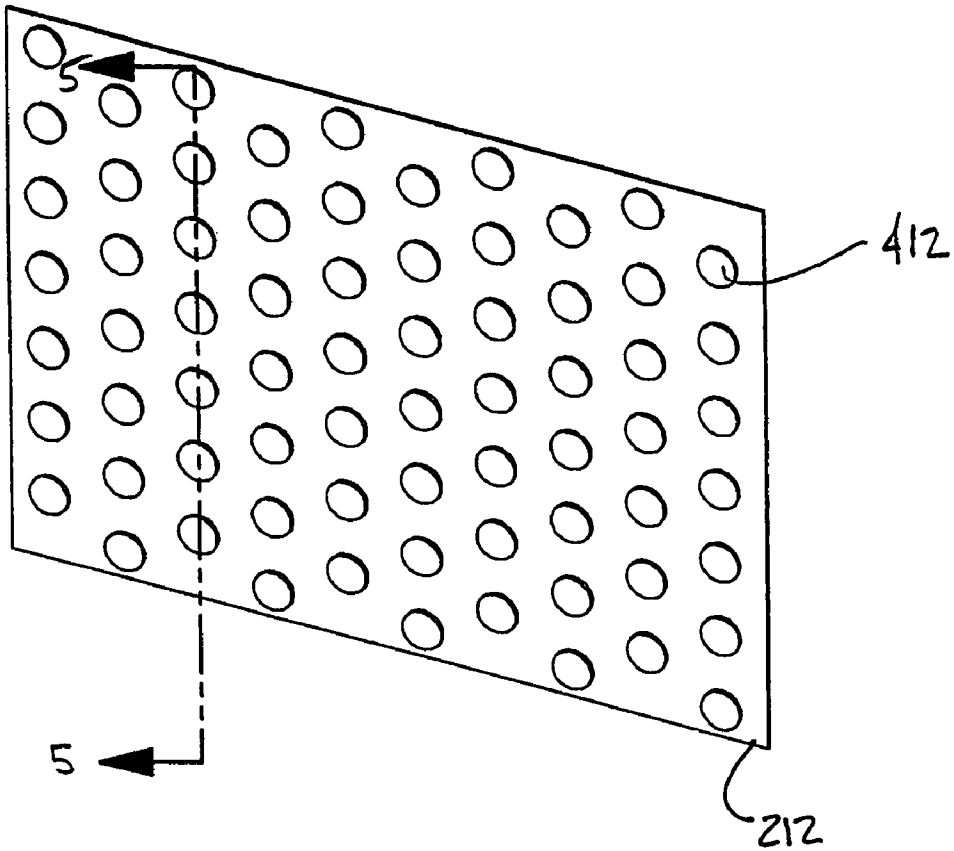
FIG. 4 illustrates a perspective view of a form according to the present disclosure.
Figure 5:
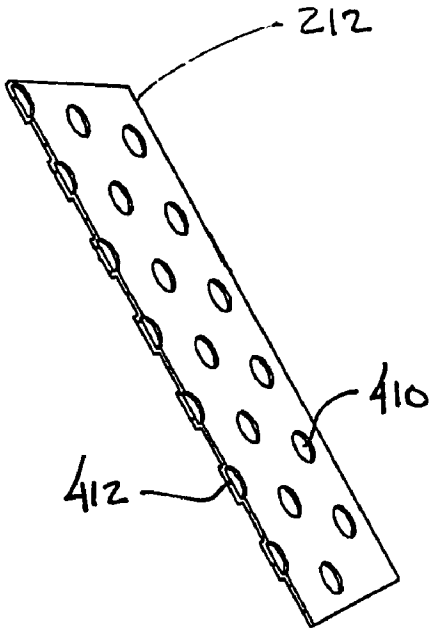
FIG. 5 illustrates a view taken from line 5—5 from FIG. 4.
Figure 6:
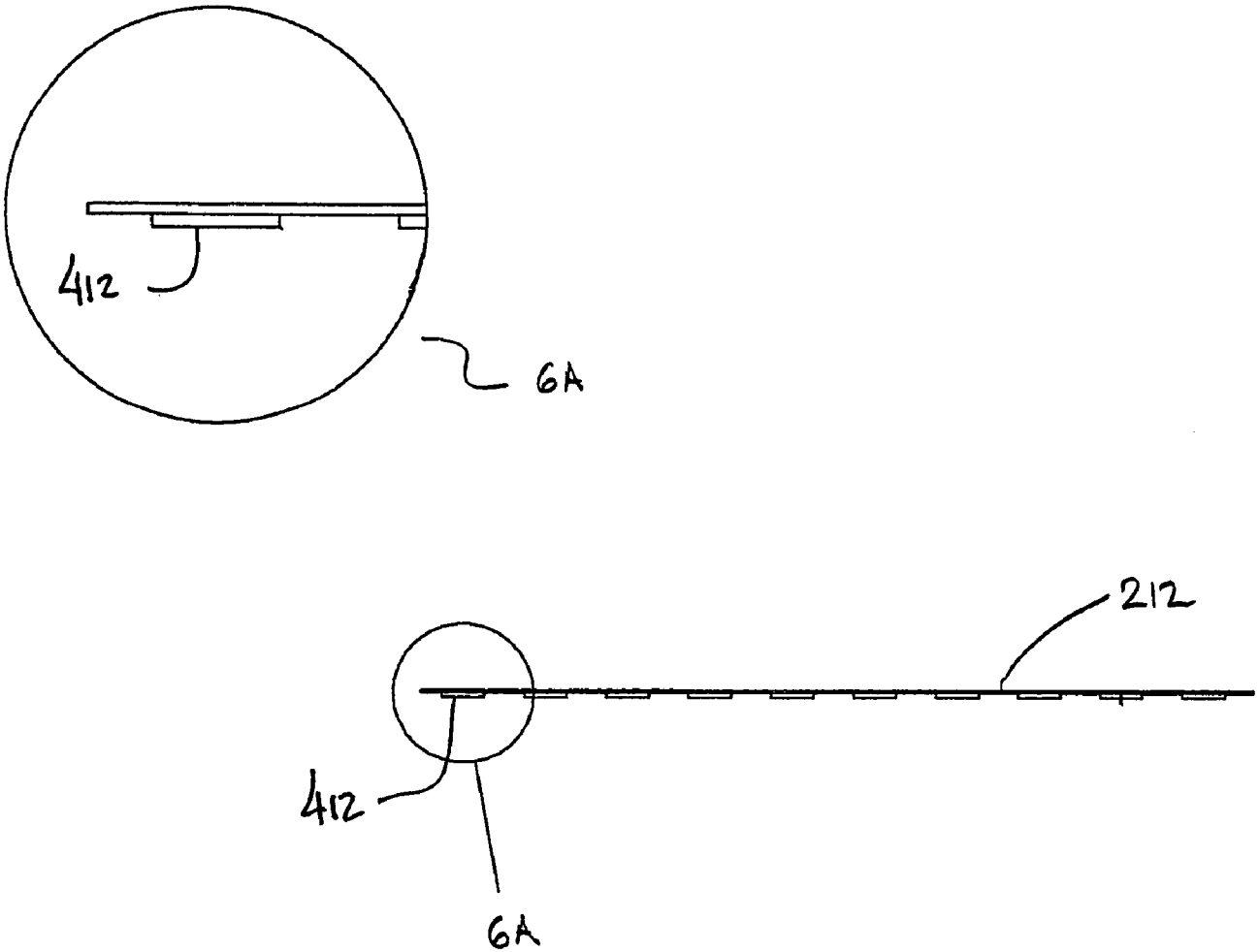
FIG. 6 illustrates a side view of the form according to the present disclosure.

FIGS. 4, 5 and 6, including view 6A, illustrate the form 212 of the present disclosure. In one embodiment, the form 212 is a thermal formed polymer sheet material that is formed during a thermal vacuum forming process. The form 212 in the illustrated example includes a plurality of female depressions 410 on a first side and corresponding male protrusions 412 on the embossing side of the form 212. The protrusions 412 and corresponding female recesses 410 are formed when the form 212 is thermal vacuum formed. The male protrusions 412 mate with the cutouts or female recesses provided in the stencil 210. Further, the side of the form 212 that includes the recesses 410 is the side that is adhered to the sleeve with the static vinyl 214. The form 212 and the stencil 210 may include any number of configurations and shapes with the only limitation being the imagination of the designer or manufacturer of the stencil 210. The dimple pattern shown in the figures are for illustrative purposes, and it should be appreciated that utilizing the thermal vacuum forming process yields a variety of forms 212 that are formed to mate with the specific shape of the stencil used.

Figure 7:
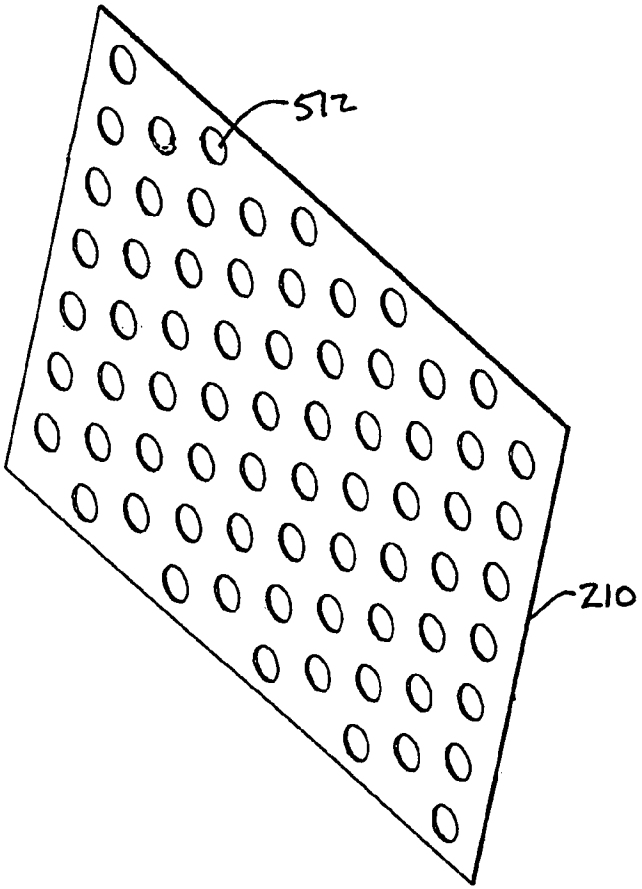
FIG. 7 illustrates a perspective view of a stencil according to the present disclosure.
Figure 8:
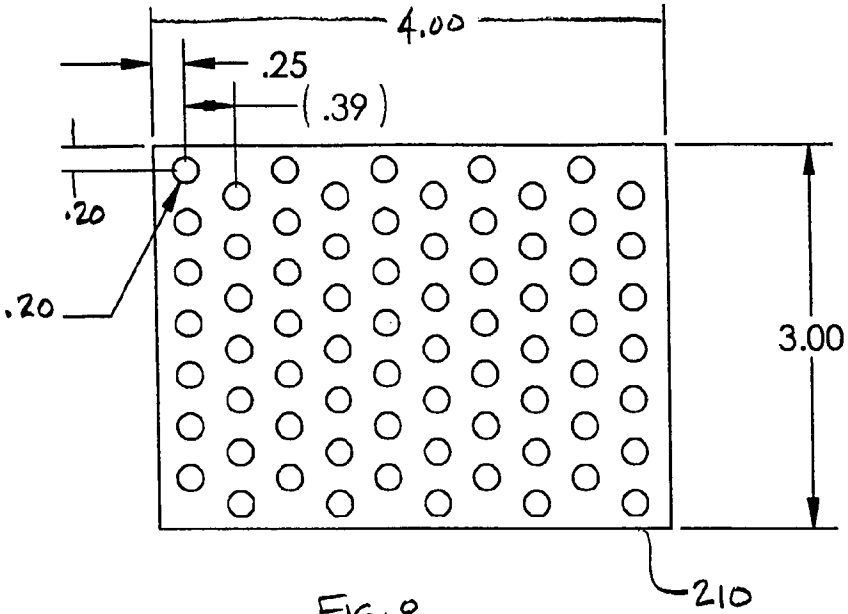
FIG. 8 illustrates a top view of the stencil according to the present disclosure.
Figure 9:
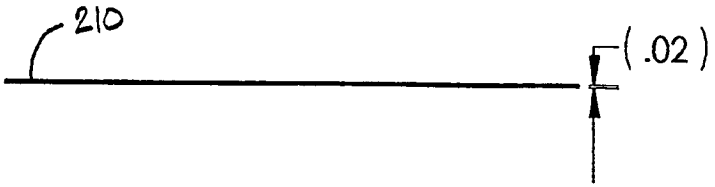
FIG. 9 illustrates a side view of the stencil according to the present disclosure.

As shown in FIGS. 7, 8, and 9, the stencil 210 is illustrated with a plurality of through holes 512. The stencil 210 is the female component of the stencil and form combination, with the through holes 512 corresponding and aligning with the protrusions in the form 212 of the current example. In the alternative, a plurality of recesses could be utilized on the stencil 210 as long as the recesses allowed enough material for the displacement of the embossing material when pressure is applied to the form 212. As stated above, the stencil 210 may be made of a metal material, such as brass, and may be manufactured by utilizing any process that provides the through holes or recesses or other shape or shapes in the stencil. For example, the through holes or the recesses may be obtained by chemically etching the stencil 210. Another alternative would be for the through holes to be created by stamping the stencil, or by machining the recesses or through holes in the stencil. If stamping or machining processes are utilized in making the stencil, the stencil most likely would need to be deburred before utilizing the stencil in the embossing system.

Figure 10:
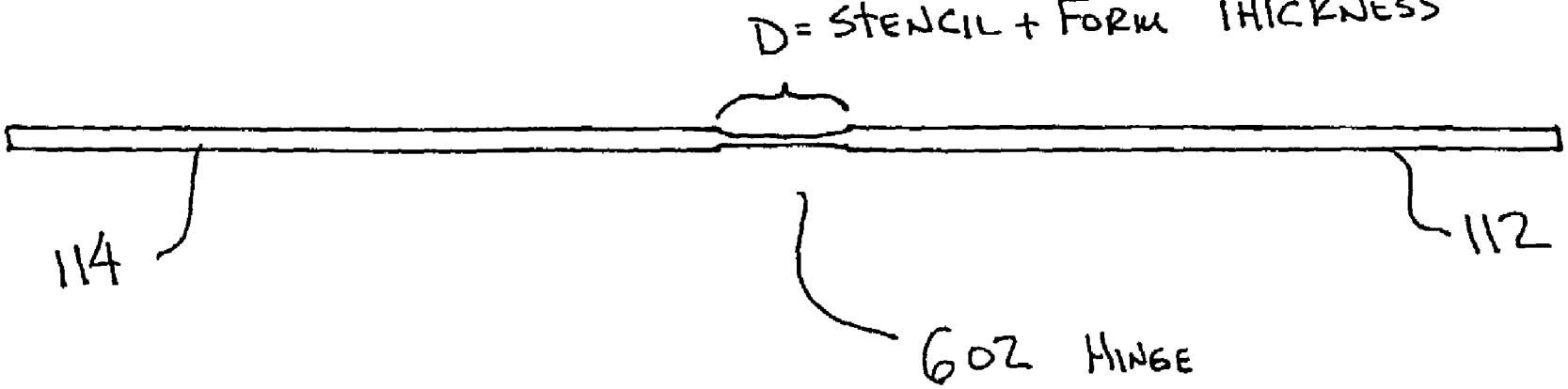
FIG. 10 illustrates a side view of an alternative embodiment of the sleeve showing an alternative hinge.

FIG. 10 illustrates an alternative embodiment of the present disclosure, wherein a hinge 602 is configured from the sleeve material. The hinge 602 may be configured by hot forming a portion of the sleeve between sections 112 and 114. The width of the hinge 602 should be approximately dimension D, which is approximately the thickness of the stencil 210 and approximately the thickness of the form 212. Hinge 602 with width D allows the sleeve assembly to close without binding and allows the sleeves 112 and 114 to evenly lay on the stencil and the form so that even pressure may be applied to the stencil and the form, without the need for a taped or plastic hinge or the need for another component to be added to the sleeve assembly. The thickness of the hinge 602 is approximately one half of the thickness of the sleeve, which provides durability and flexibility for the hinge.

Figure 11:
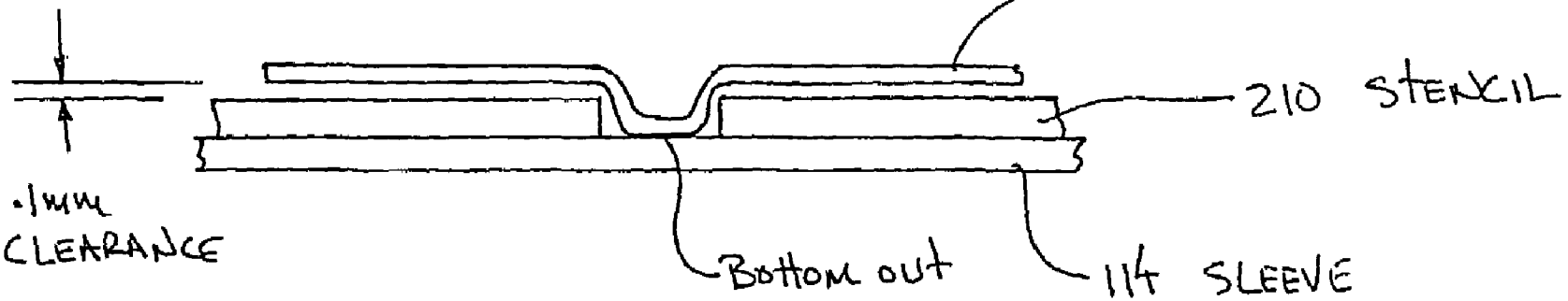
FIG. 11 illustrates a partial side view of an embossing system of an alternative embodiment, wherein a clearance is provided between the form and the stencil.

FIG. 11 illustrates an alternative embodiment of the present disclosure, wherein the form 212 is configured so that when the form 212 is bottomed out in the stencil 210 and the sleeve 114, approximately a 0.1 mm gap is provided between the form 212 and the stencil 210. This gap provides the advantage of not crushing the sheet material being embossed. For example, without the gap, if paper is being embossed, the paper becomes shiny since pressure is applied to the paper through the sleeve assembly. This particularly becomes a problem when the paper being embossed is a textured paper. The gap provided by the clearance prevents the sleeve assembly from applying compressive forces, or an extraordinary amount of compressive forces to the sheet material.

In an alternative embodiment, instead of using static vinyl to adhere the form and the stencil to the sleeves, a double sticky paper or fiber tape may be used that is approximately 0.001–0.0015 inches thick. The paper or fiber has a relatively low tack so that as the forms and the stencils are removed, the adhesive may be easily removed from the sleeves. Then, new adhesive is placed on the sleeves to adhere the next form and stencil being used.

If the embossing system of the present disclosure is utilized with a die press with upper and lower platens, an adapter may be required to make up for the difference between the thickness of the shuttle of the present disclosure versus the die that may be used or sold with the existing die press. In the alternative, shims may be utilized with the existing adapter so that the shuttle of the present disclosure may be used with an existing die press.

In an alternative embodiment, a chemical etched die may be used as the male portion or the female portion of the present disclosure.

Also, in an alternative embodiment, instead of pivotally attaching the top sleeve 112 with the bottom sleeve 114 with a flange 116, pins may be utilized so that the plastic sleeves may be quickly located relative to each other, by placing the sleeves 112 and 114 through at least two locating pins that extend from either an adapter or the die press, such as the base of the die press.

Although this disclosure has been shown and described with respect to detailed embodiments, those skilled in the art will understand that various changes in form and detail may be made without departing form the scope of the claimed disclosure.

What is claimed is:

1. An embossing system, comprising:

a sleeve having a first part and a second part;

a stencil being adapted to be positioned between the sleeve first part and sleeve second part; and a form being adapted to be positioned between the stencil and either the sleeve first part or sleeve second part, and having at least one projection that maintains a clearance between a surface of the stencil and a surface of the form distinct from the at least one projection when the form is compressed towards the stencil while positioned in the sleeve.

2. The embossing system of claim 1, wherein the embossing system is adapted to accept embossing material between the form and the stencil.

3. The embossing system of claim 1, wherein an adhesive is disposed between the form and the sleeve first part or the sleeve second part to hold the form stationary relative to the sleeve.

4. The embossing system of claim 3, wherein static vinyl is disposed between the form and the sleeve first part or the sleeve second part to hold the form stationary relative to the sleeve.

5. The embossing system of claim 1, wherein an adhesive holds the stencil in place against the sleeve first part or the sleeve second part.

6. The embossing system of claim 1, wherein the stencil is made of a metallic material.

7. The embossing system of claim 1, wherein the form is made of a plastic material.

8. The embossing system of claim 1, wherein the sleeve first part and the sleeve second part are connected by a hinge.

9. The embossing system of claim 1, wherein the form comprises at least one vacuum formed plastic projection.

10. An embossing system, comprising:

a force transfer assembly comprising:

a first cover, an opposite second cover; and a hinge connecting said first cover and said second cover; and said force transfer assembly further comprising a stencil and an opposing vacuum formed plastic form positioned internal of the force transfer assembly, said stencil and said form being adapted to sandwich an embossing material between said stencil and said form;

wherein at least one projection on the form operates to maintain a clearance between a surface of the form distinct from the at least one projection and the stencil when the embossing system is compressed.

11. The embossing system of claim 10, wherein a layer of static vinyl is located between one of the covers to secure the form to one of the covers.

12. The embossing system of claim 11, wherein an adhesive is located on the cover opposite the cover with the vinyl to secure the stencil.

13. The embossing system of claim 10, wherein when the force transfer assembly is in a compressed position, the clearance between the form and the stencil is approximately 0.1 millimeter.

14. The embossing system of claim 13, wherein the hinge is a reduced thickness area joining the first cover and the opposite second cover.

15. The embossing system of claim 14, wherein the first cover, the second cover, and the hinge are made from a continuous sheet of material.

16. The embossing system of claim 15, wherein the hinge is made of a clear material.

17. The embossing system of claim 14, wherein the hinge provides for the clearance between the form and the stencil when the embossing system is operated.

18. The embossing system of claim 17, wherein the clearance is at least 0.1 millimeter.

19. The embossing system of claim 10, wherein the force transfer assembly includes at least two apertures so that the force transfer assembly is adapted to be located on pins located on a die press.

20. The embossing system of claim 10, wherein the hinge means comprises a plastic material.

21. The embossing system of claim 10, wherein the hinge means is an adhesive film material.

22. The embossing system of claim 21, wherein the adhesive film material is a tape material.

23. The method for embossing and embossing material, comprising the steps of:

providing a force transfer assembly, which includes a first cover, an opposition second cover, and a hinge for connecting the first cover and the second covers;

providing a stencil and an opposing form that is adapted to be positioned internal of the force transfer assembly, the stencil and the form being adapted to sandwich an embossing material between the stencil and the form;

the force transfer assembly adapted to compress the form against the embossing material and in the direction of the stencil until at least one projection on the form impedes further compression, the at least one projection maintaining a clearance between portions of the form distinct from the at least one projection and the stencil.

* * * * *